US005081410A

United States Patent [19]

Wood

[11] Patent Number: 5,081,410

[45] Date of Patent: Jan. 14, 1992

[54] BAND-GAP REFERENCE

[75] Inventor: Grady M. Wood, Melbourne, Fla.

[73] Assignee: Harris Corporation, Melbourne, Fla.

[21] Appl. No.: 529,548

[22] Filed: May 29, 1990

[51] Int. Cl.[5] ..... G05F 1/56; H03F 3/45

[52] U.S. Cl. ..... 323/316; 323/315; 330/108; 307/296.1

[58] Field of Search ..... 323/312, 313, 314, 315, 323/316; 330/259, 108; 307/296.1, 296.6

[56] References Cited

U.S. PATENT DOCUMENTS

| | | | |
|---|---|---|---|
| 3,731,215 | 11/1973 | Peil et al. | 330/259 |
| 3,956,645 | 5/1976 | Boer | 307/264 |
| 4,087,758 | 5/1978 | Hareyama | 330/108 |
| 4,413,226 | 11/1983 | Davies | 323/303 |
| 4,435,678 | 3/1984 | Joseph et al. | 323/273 |
| 4,441,070 | 4/1984 | Davies et al. | 323/268 |
| 4,628,279 | 12/1986 | Nelson | 330/257 |
| 4,902,959 | 2/1990 | Brokaw | 323/314 |

*Primary Examiner*—Peter S. Wong
*Assistant Examiner*—Emanuel Todd Voeltz
*Attorney, Agent, or Firm*—Evenson, Wands, Edwards, Lenahan & McKeown

[57] ABSTRACT

A band-gap reference having a differential amplifier with first and second inputs and an output, and a voltage divider coupled to the differential amplifier output. A first transistor having a base, emitter and collector, has its base coupled to the voltage divider, the first transistor having an emitter current density of x. A second transistor having a base, emitter and collector, has its base coupled to the voltage divider, the second transistor having an emitter current density of nx, where n is fixed. A third transistor having a base, emitter and collector, has its base coupled to the emitter of the first transistor, and its collector coupled to the first input of the differential amplifier. A fourth transistor having a base, emitter and collector, has its base coupled to the emitter of the second transistor, and its collector coupled to the second input of the differential amplifier, and the emitter of the fourth transistor being coupled to the emitter of the third transistor. The threshold voltage term for the band-gap reference is derived by setting the emitter current density for the input transistors of the differential amplifier at a fixed ratio, so that there is only one stable operating point, thereby eliminating the need for additional start-up circuitry and allowing the band-gap reference to be used in transient radiation environments.

6 Claims, 5 Drawing Sheets

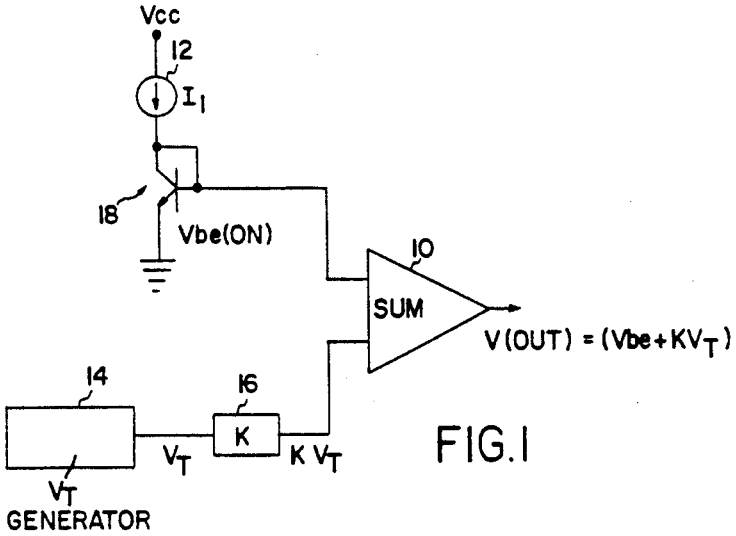
FIG.1
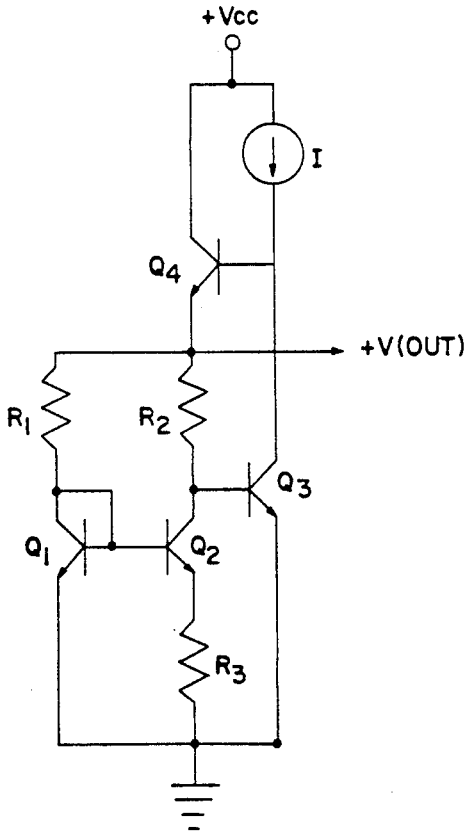
FIG.2
PRIOR ART
FIG.4
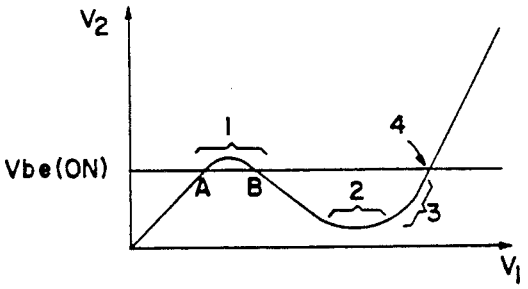
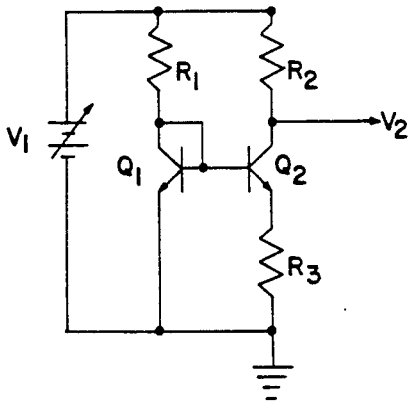
FIG.3
PRIOR ART

BAND-GAP REFERENCE

FIELD OF THE INVENTION

The present invention relates to the field of integrated circuits, and more specifically, to a circuit for providing a band-gap reference voltage to an integrated circuit.

BACKGROUND OF THE INVENTION

Linear integrated circuits often require a stable voltage reference that does not change substantially with temperature, operating voltage, or run-to-run resistor variations. In many cases, Zener-referenced bias circuits generate too much noise to be useful. Since sources that are referenced to the base-emitter voltage (Vbe(on)) and the threshold voltage ($V_t$) have opposite temperature coefficients $TC_f$, it is possible to construct a circuit that references its output voltage to a weighted sum of Vbe(on) and $V_t$. By proper weighting, a near zero temperature coefficient $TC_f$ can be attained. Voltage variations of less than 50 ppm/° C. over the military temperature range of −55° C. to 125° C. can be obtained. This class of reference circuits is normally referred to as band-gap references because the output voltage level at which zero $TC_f$ occurs is approximately equal to the band-gap of silicon. The mathematical derivation of this value can be found in the book "Analysis and Design of Integrated Circuits" by Paul R. Gray and Robert G. Meyer.

Prior implementations of the band-gap reference have taken several forms. One of the simpler forms utilizes a feedback loop to establish an operating point in the circuit such that the output voltage is equal to a Vbe(on) plus a voltage proportional to the difference between two base-emitter voltages. The operation of the feedback loop will be described in more detail later. However, it should be noted here that this type of band-gap reference has three stable operating points. If the circuit is to be operated in high transient radiation environments, then one must be concerned with the possibility of transient radiation induced photocurrents flipping the circuits to one of the other two stable operating points. Special "startup" circuitry is typically used to constrain the gain loop of the circuitry to operate at the desired stable operating point. However, the possibility still exists that transient radiation will cause this type of circuitry to switch to the second (undesired) stable operating point. Another problem with this known reference circuit is that the current on which the voltage reference is based is derived from the power supply and therefore may vary with power supply variations.

Another band-gap reference circuit is known that is essentially independent of supply variations. This known circuit will be described in more detail later. For now, it is sufficient to note that this known circuit will have, under certain conditions, two stable operating points.

An object of the present invention is to provide a band-gap reference circuit which has only one stable operating point. Such a circuit needs to meet voltage regulator requirements of linear/analog circuits designed for high radiation environments. This is because band-gap reference circuits which have more than one stable operating point pose special problems in radiation environments. The possibility exists that photocurrents generated by high Gamma rate exposure could cause the circuit to switch to an undesirable operating point. There is therefore the need for a band-gap reference circuit that eliminates the need for any special start-up circuitry and provides stability in transient radiation environments.

SUMMARY OF THE INVENTION

These and other objects are achieved by the present invention which provides a band-gap reference having a differential amplifier with first and second inputs and an output, and a voltage divider coupled to the differential amplifier output. A first transistor having a base, emitter and collector, has its base coupled to the voltage divider, the first transistor having an emitter current density of x. A second transistor having a base, emitter and collector, has its base coupled to the voltage divider, the second transistor having an emitter current density of nx, where n is fixed. A third transistor having a base, emitter and collector, has its base coupled to the emitter of the first transistor, and its collector coupled to the first input of the differential amplifier. A fourth transistor having a base, emitter and collector, has its base coupled to the emitter of the second transistor, and its collector coupled to the second input of the differential amplifier, the emitter of the fourth transistor being coupled to the emitter of the third transistor. The threshold voltage term for the band-gap reference of the present invention is derived by setting the emitter current density for the input transistors of the differential amplifier at a fixed ratio, so that there is only one stable operating point, thereby eliminating the need for additional start-up circuitry.

One of the advantages provided by the present invention is that the calculations required to set resistor ratios for proper temperature compensation is simplified using the present invention. Another advantage is the elimination of any need for special start-up circuitry. Further, the present invention is particularly useful in transient radiation environments, since it will provide stability in such environments.

Other objects, advantages and novel features of the present invention will become apparent from the following detailed description of the invention when considered in conjunction with the accompanying drawings.

BRIEF DESCRIPTION OF THE DRAWINGS

FIG. 1 shows a schematic illustration of a fundamental band-gap reference.

FIG. 2 shows a schematic diagram of a prior art band-gap reference.

FIG. 3 shows a subcircuit of the prior art band-gap reference of FIG. 2.

FIG. 4 shows a plot of $V_1$ and $V_2$ for the subcircuit of FIG. 3.

DETAILED DESCRIPTION OF THE DRAWINGS

Figure 5:
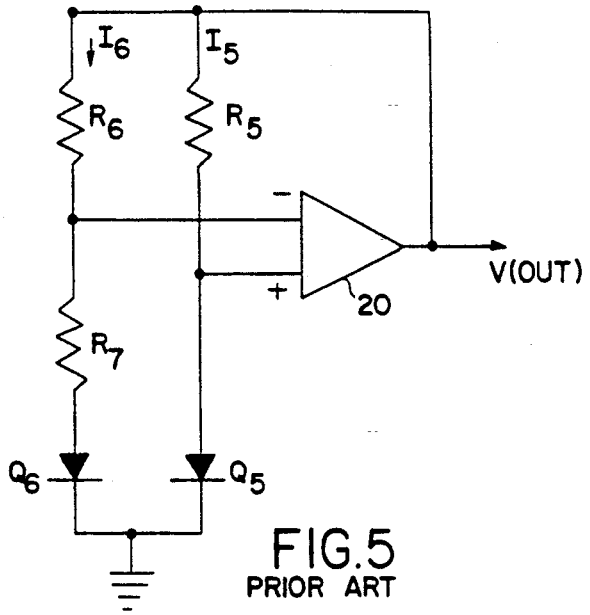
FIG.5 PRIOR ART
FIG. 5 shows a schematic diagram of another prior art band-gap reference.

FIG. 1 illustrates a fundamental band-gap reference circuit having a summing amplifier 10, a current source 12, a threshold voltage generator 14, a multiplier 16, and a transistor 18. A circuit that produces a stable voltage reference that does not change substantially with temperature is often required by linear integrated circuits. In the illustrated circuit, the output voltage, at the output of the summing amplifier 10, is a weighted sum of the base-emitter voltage of transistor 18, Vbe-(on), and the threshold voltage $V_t$. In equation form, for the circuit of FIG. 1, $V(out)=(Vbe+KV_t)$. Sources referenced to Vbe(on) and to $V_t$ will have opposite temperature coefficients $TC_f$. Therefore, with proper weighting by the multiplier 16, a near zero temperature coefficient $TC_f$ can be attained. The class of reference circuits shown in FIG. 1 is normally referred to as band-gap reference circuits because the output voltage level at which zero $TC_f$ occurs is approximately equal to the band-gap of silicon.

Prior implementations of a band-gap reference have taken several forms. One of the simpler forms is shown in FIG. 2. This circuit utilizes a feedback loop to establish an operating point in the circuit such that the output voltage is equal to a Vbe(on) plus a voltage proportional to the difference between two base-emitter voltages. The operation of the feedback loop is best understood by reference to FIG. 3, in which a subcircuit of the circuit is shown. Reference will also be made to FIG. 4, which shows the variation of the output voltage $V_2$, as the input voltage $V_1$, is varied from zero in the positive direction. Initially, with $V_1$ set at zero, devices $Q_1$ and $Q_2$ are not conducting and $V_2=0$. As $V_1$ is increased, $Q_1$ and $Q_2$ do not conduct significant current until the input voltage reaches about 0.6 V. During this time, output voltage $V_2$ is equal to $V_1$ since there is no voltage drop in $R_2$. When $V_1$ exceeds 0.6 V, however, $Q_1$ begins to conduct current. This corresponds to region 1 in FIG. 4. The magnitude of the current in $Q_1$ is approximately equal to $(V_1-0.6\ V)/R_1$. For small values of this current, $Q_1$ and $Q_2$ carry the same current since the drop across $R_1$ will be negligible at low currents. Since the resistor $R_2$, is much larger than $R_1$, the voltage drop across it is much larger than $(V_1-0.6\ V)$, and transistor $Q_2$ saturates. This corresponds to region 2 in FIG. 4. Because of the presence of $R_3$, the collector current that would flow in $Q_2$ if it were in the forward-active region has an approximately logarithmic dependence on $V_1$.

As $V_1$ is further increased, a point is reached at which $Q_2$ comes out of saturation. This occurs because $V_1$ increases faster than the voltage drop across $R_2$. This is labeled region 3 in FIG. 4. Referring back to the complete circuit of FIG. 2, if transistor $Q_3$ is initially turned off, transistor $Q_4$ will drive $V_1$ in the positive direction. This will continue until enough voltage is developed at the base of $Q_3$ to produce a collector current in $Q_3$ approximately equal to I. Thus the circuit stabilizes with voltage $V_2$ equal to one diode drop, the base-emitter voltage of $Q_3$. Note that this can occur at regions 1A, 1B, and 4. Appropriate start-up circuitry must be included to ensure operation at region (or operating point) 4. If the circuit of FIG. 2 is designed to be operated in high transient radiation environments, then one must be concerned with the possibility of transient radiation induced photocurrents flipping the circuits to one of the other two stable operating points.

Assuming that the circuit has reached a stable operating point at region 4, it can be seen that the output voltage V(out) is the sum of the base-emitter voltage of $Q_3$ and the voltage drop across $R_2$. The drop across $R_2$ is equal to the voltage drop across $R_3$ multiplied by $(R_2/R_3)$ since the collector current of $Q_2$ is approximately equal to the emitter current. The voltage drop across $R_3$ is equal to the difference in base-emitter voltage of $Q_1$ and $Q_2$. The ratio of current in $Q_1$ and $Q_2$ is set by the ratio of $R_2$ to $R_1$. A drawback of this band-gap reference is that the current I is derived from the power supply and may vary with power-supply variations.

Another band-gap reference circuit is shown in FIG. 5, this circuit being essentially independent of supply variations. If it is assumed that a stable operating point exists for this circuit then the differential input voltage of differential amplifier 20 must be zero and resistors $R_5$ and $R_6$ must have equal voltage across them. Thus, the two currents $I_5$ and $I_6$ must have a ratio determined by the ratio of $R_5$ to $R_6$. Note that these two currents are the collector currents of the two diode-connected transistors $Q_6$ and $Q_5$, assuming base currents are negligible. Thus, the difference between their base-emitter voltage is $$\Delta Vbe = V_T \ln[I_5 I_{S6}/I_6 I_{S5}] = V_T \ln[R_6 I_{S6}/R_5 I_{S5}]$$

This voltage appears across resistor $R_7$. The same current that flows in $R_7$ also flows in $R_6$, so that the voltage across $R_6$ must be:

$$V_{R6} = R_6/R_7 \Delta Vbe = R_6/R_7 V_T \ln[R_6 I_{S6}/R_5 I_{S5}]$$

The output voltage is the sum of the voltage across $R_5$ and the voltage across $Q_5$. The voltage across $R_5$ is equal to that across $R_6$ as discussed above. The output voltage is therefore:

$$V_{out} = V_{be1} + R_6/R_7 V_T \ln[R_6 I_{S6}/R_5 I_{S5}] = V_{be1} + KV_T$$

The circuit of FIG. 5 thus behaves as a band-gap reference, with the value of K set by the ratio of $(R_6/R_5)$, $(R_6/R_7)$ and $I_{S5}/I_{S6}$.

Figure 6:
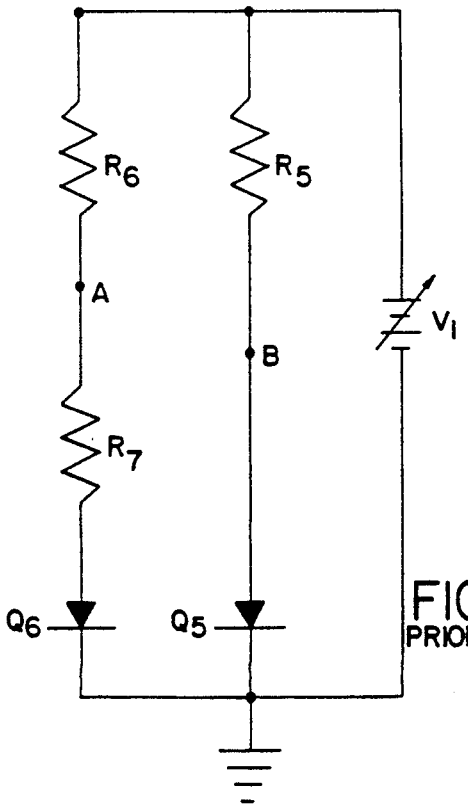
FIG.6 PRIOR ART
FIG. 6 shows a subcircuit of the prior art band-gap reference of FIG. 5.
Figure 7:
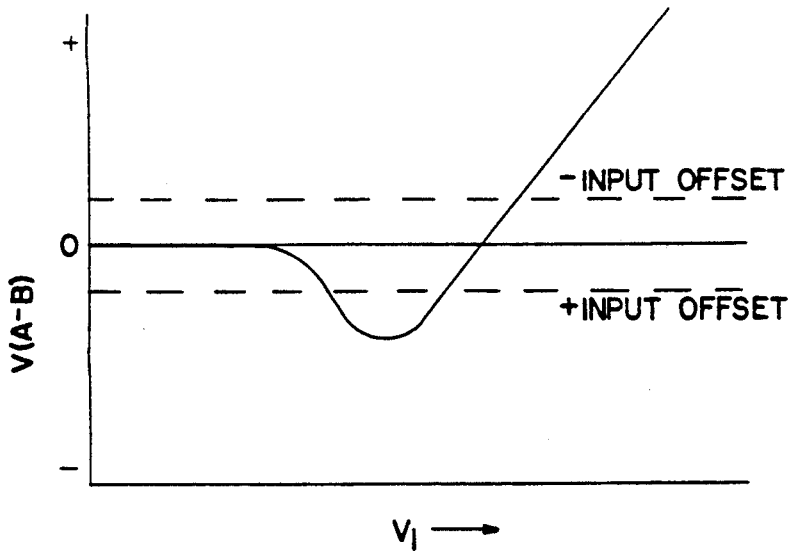
FIG. 7 shows a plot of $(V_A-V_B)$ vs $V_1$ for the subcircuit of FIG. 6.

For the purposes of circuit analysis, the differential amplifier 20 is removed, as shown in FIG. 6. The normal output node is driven with a variable voltage $(V_1)$. The plot of $(V_A-V_B)$ vs $V_1$ is illustrated in FIG. 7. The operating points where the circuit is stable are indicated by the points where the voltage at node A and node B are equal. (These nodes would normally represent the input nodes to the differential amplifier 20.)

FIG. 7 shows a plot of $V_A-V_B$ as a function of the voltage $V_1$. This plot clearly demonstrates that there is more than one stable solution If the voltage is less than 0.6 V, then very little current flows in either leg of the circuit. Therefore, the voltages at node A and node B are essentially equal and represent a stable solution for any value of voltages less than 0.6 V. In practical implementations, the offset voltage of the differential input pair of the amplifier 20 is seldom exactly equal to zero. As can be seen in FIG. 7, an input offset in the positive direction will result in a circuit with two stable solutions while an input offset in the negative direction will result in a circuit with only one stable solution.

Figure 8:
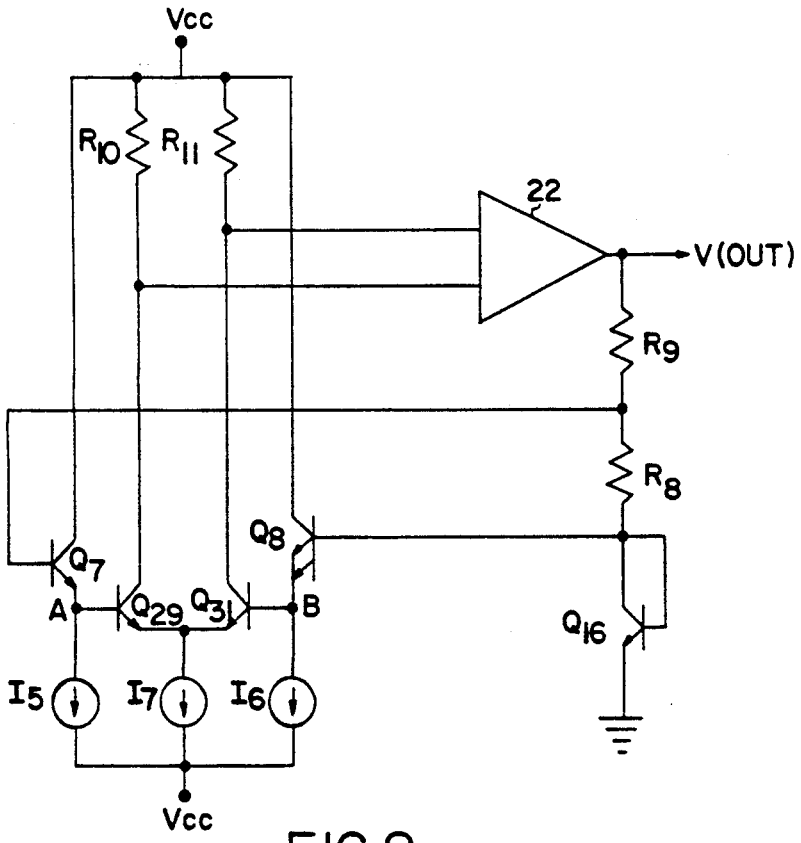
FIG. 8 shows a schematic illustration of a band-gap reference constructed in accordance with an embodiment of the present invention.
Figure 9:
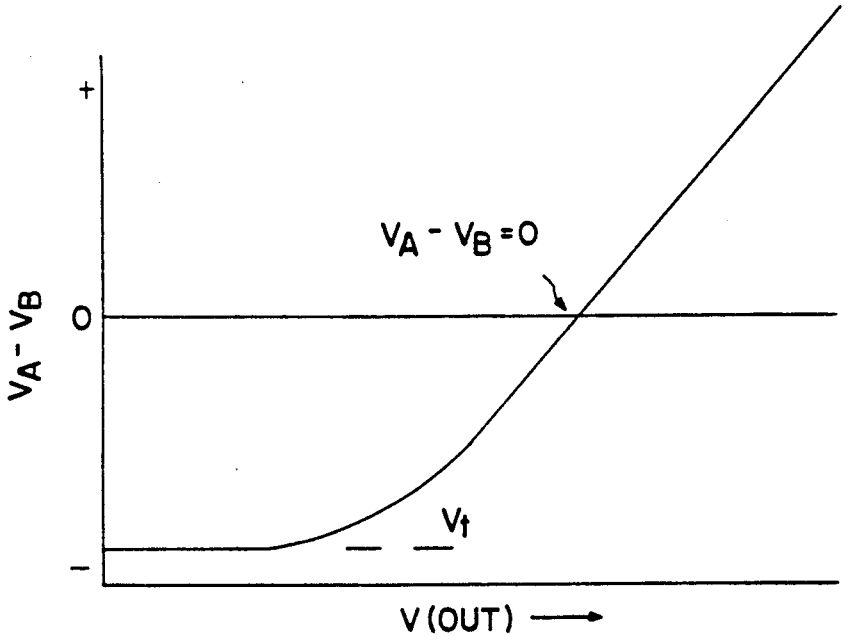
FIG. 9 shows a plot of $(V_A-V_B)$ vs V(out) for the band-gap reference of FIG. 8.

A basic schematic diagram of an embodiment of the present invention is shown in FIG. 8. The input stage of the differential amplifier 22 is shown in schematic form while the subsequent stages are shown in block format. In this embodiment of the invention, the emitter area of transistor $Q_8$ is set to be twice that of transistor $Q_7$ and current sinks $I_5$ and $I_6$ are set to be equal. If high transistor gain is assumed such that the base currents can be ignored, then the gain loop has a stable operating point when the voltage at node A is equal to the voltage at node B. Since transistors $Q_7$ and $Q_8$ have different emitter areas and are operating at the same emitter current, then the voltages at nodes A and B can be equal only when the output of the amplifier is sufficient to cause a current to flow in $R_8$ such that the "IR drop" across $R_8$ is equal to the difference in the base-emitter voltage Vbe of $Q_7$ and $Q_8$. This is shown graphically in FIG. 9. The current $I_5$ can then be calculated as follows:

$$I_5 = V_t/R_8$$

As is the case with prior art designs, the output voltage is equal to the weighted sum of Vbe and $V_t$. In other words, the output voltage is given by the equation:

$$V(out) = Vbe + KV_t$$

Where: (for the present invention)

$$K = (R_9 + R_8)/R_8$$

Thus, the two equations above illustrate the simplicity of calculating the operating currents and the output voltage V(out) for the band-gap reference of the present invention, since the value of K can be set simply by setting the values of the resistances $R_9$ and $R_8$.

In practice, the voltage at which minimum output variation with respect to temperature is achieved is seldom equal to the band-gap voltage. Small errors are introduced by the non-ideal behavior of the transistors, the temperature coefficient of the resistors and other parasitic effects. A way of reducing one of the major effects is to use circuit design techniques that minimize the input currents of the differential amplifier 22.

Figure 10:
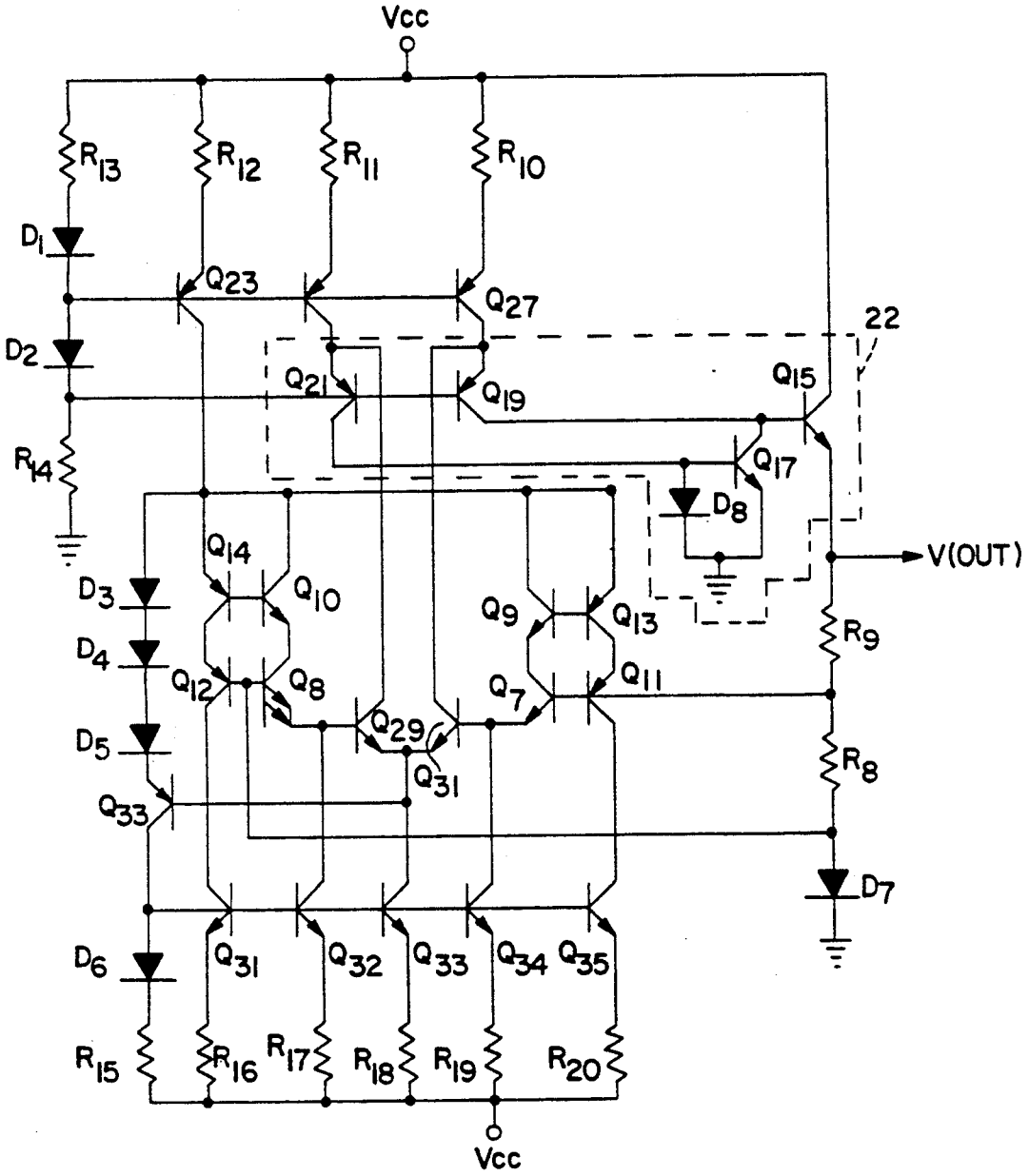
FIG. 10 shows a more detailed schematic diagram of the band-gap reference of FIG. 9.

FIG. 10 shows an embodiment of the present invention that accomplishes this minimization of the input currents of the differential amplifier 22. This type of input design results in a very low input bias current because of the cancellation effect of the base currents of the illustrated NPN and PNP transistors. This type of input design results in typical input bias currents of 20 na or less which is insignificant when compared to the operating currents of the input resistors. The low input bias currents also contributes to increased neutron hardness because HFE degradation caused by neutron exposure degrades the HFE of both the NPN and PNP transistors resulting in a small delta in a number which is already insignificant.

As discussed above with respect to FIG. 8, the transistor $Q_8$ operates at twice the emitter current density of input transistor $Q_7$ which establishes the $V_1$ term. This has the effect of setting the emitter current density for the input transistors $Q_{19}$, $Q_{21}$ of the differential amplifier 22 at a fixed ratio. With such a design, there is no need for additional start-up circuitry.

The embodiment of the invention illustrated in FIG. 10 includes a four diode clamp structure 40, and includes diodes $D_3$, $D_4$, $D_5$, and $Q_{33}$. This four diode clamp structure 40 allows all of the eight input transistors to operate at the same collector-base voltage, thereby eliminating what are commonly known as early voltage effects.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. A band-gap reference comprising:

a differential amplifier having first and second inputs and an output;

a voltage divider coupled to the differential amplifier output;

a first transistor having a base, emitter and collector, the base of the first transistor being coupled to the voltage divider, the first transistor having an emitter current density of x;

a second transistor having a base, emitter and collector, the base of the second transistor coupled to the voltage divider, the second transistor having an emitter current density of nx, where n is fixed;

a third transistor having a base, emitter and collector, the base of the third transistor being coupled to the emitter of the first transistor, and the collector of the third transistor being coupled to the first input of the differential amplifier; and a fourth transistor having a base, emitter and collector, the base of the fourth transistor being coupled to the emitter of the second transistor, the collector of the fourth transistor being coupled to the second input of the differential amplifier, and the emitter of the fourth transistor being coupled to the emitter of the third transistor;

wherein the voltage divider includes first and second resistors, the first resistor being coupled at one end to the output of the differential amplifier, and coupled at another end to one end of the second resistor and to the base of the first transistor, and the second resistor coupled at another end to the base of the second transistor;

further comprising first, second and third current sinks, the first current sink being coupled to the emitter of the first transistor, the second current sink being coupled to the emitter of the second transistor, and the third current sink being coupled to the emitters of the third and fourth transistors;

further comprising means for eliminating early voltage effects.

2. The band-gap reference of claim 1, wherein the means for eliminating early voltage effects is a clamp structure coupled between the base of the first transistor and the emitters of the third and fourth transistors.

3. The band-gap reference of claim 2, wherein the clamp structure includes a plurality of serially coupled diodes.

4. The band-gap reference of claim 1, wherein n is 2

5. A circuit for providing a stable voltage reference comprising:

a differential amplifier having first and second inputs and an output; and means for providing a single stable operating point at the output of said differential amplifier;

wherein the means for providing includes a first input transistor coupled to the first input of the differential amplifier, and a second input transistor coupled to the second input of the differential amplifier;

wherein the first and second input transistors have emitter current densities, the emitter current densities for the first and second input transistors being set at a fixed ratio;

wherein the emitter current density for the second input transistor is twice the emitter current density of the first input transistor;

further comprising means for eliminating early voltage effects.

6. The circuit of claim 5, wherein the means for eliminating includes a diode clamp structure coupled to one of the first and second input transistors.

* * * * *